US012369730B2

(12) United States Patent
Obitts et al.

(10) Patent No.: US 12,369,730 B2
(45) Date of Patent: Jul. 29, 2025

(54) RETAIL SHELVING SYSTEM

(71) Applicants: Shane Obitts, North Ridgeville, OH (US); Billy Mertz, Cincinnati, OH (US); Matt Grubbs, Union, KY (US)

(72) Inventors: Shane Obitts, North Ridgeville, OH (US); Billy Mertz, Cincinnati, OH (US); Matt Grubbs, Union, KY (US)

(73) Assignee: Fasteners for Retail, Inc., Twinsburg, OH (US)

( * ) Notice: Subject to any disclaimer, the term of this patent is extended or adjusted under 35 U.S.C. 154(b) by 0 days.

(21) Appl. No.: 18/972,427

(22) Filed: Dec. 6, 2024

(65) Prior Publication Data

US 2025/0098858 A1 Mar. 27, 2025

Related U.S. Application Data

(63) Continuation of application No. 17/826,769, filed on May 27, 2022, now Pat. No. 12,213,601, which is a (Continued)

(51) Int. Cl.

| | |
|---|---|
| ***A47F 5/00*** | (2006.01) |
| ***A47B 57/42*** | (2006.01) |
| ***A47B 96/02*** | (2006.01) |
| ***A47F 5/10*** | (2006.01) |
| *A47B 57/04* | (2006.01) |
| *A47B 96/06* | (2006.01) |
| *A47B 96/07* | (2006.01) |
| *A47B 96/14* | (2006.01) |

(52) U.S. Cl.

CPC ..... *A47F 5/0043* (2013.01); *A47B 57/42* (2013.01); *A47B 96/021* (2013.01); *A47B 96/027* (2013.01); *A47B 96/028* (2013.01); *A47F 5/0018* (2013.01); *A47F 5/103* (2013.01); *A47B 57/04* (2013.01); *A47B 96/024* (2013.01); *A47B 96/061* (2013.01); *A47B 96/07* (2013.01); *A47B 96/1408* (2013.01); *A47F 5/005* (2013.01)

(58) Field of Classification Search

CPC ..... A47B 96/021; A47B 96/028; A47B 96/02; A47B 96/027; A47B 96/061; A47B 57/42; A47F 5/0043; A47F 5/0018; A47F 5/103; A47F 5/005

See application file for complete search history.

(56) References Cited

U.S. PATENT DOCUMENTS 2,305,244 A 12/1949 Erickson
2,933,195 A * 4/1960 Radek ..... A47B 57/58 248/220.42

(Continued)

FOREIGN PATENT DOCUMENTS

FR 2988279 A1 9/2013
KR 20070109517 A 11/2007

*Primary Examiner* — Kimberley S Wright
(74) *Attorney, Agent, or Firm* — Reinhart Boerner Van Deuren P.C.

(57) ABSTRACT

A shelving system is provided. The shelving system includes an upper rail, and optionally a lower rail, from which one or more upright supports extend. The upright supports are slidable within the upper and lower rails so that a user may vary their location. A shelf mounts to the upright supports. The shelf includes interlocking deck panels and selectively removable support bars so that it may be assembled onto the upright supports.

9 Claims, 15 Drawing Sheets

Related U.S. Application Data continuation of application No. 16/222,722, filed on Dec. 17, 2018, now Pat. No. 11,369,215.

(56) References Cited

U.S. PATENT DOCUMENTS 3,237,779 A 3/1966 Eger
3,285,428 A 11/1966 Scheck
3,297,374 A 1/1967 Radek
3,298,503 A 1/1967 Field et al.
3,302,800 A 2/1967 Zdanowski
3,358,847 A 12/1967 Magnuson
3,403,787 A 10/1968 Browning
3,465,891 A 9/1969 Rose
3,610,427 A 10/1971 Maziarka et al.
3,827,574 A 8/1974 Craig, Sr.
3,832,957 A * 9/1974 Mendenhall ..... A47B 96/021 108/108
4,078,664 A 3/1978 McConnell
4,250,679 A 2/1981 Burg
4,467,927 A 8/1984 Nathan
4,540,222 A 9/1985 Burrell
4,665,838 A 5/1987 Minshall
4,815,394 A 3/1989 Ettlinger et al.
4,955,490 A 9/1990 Schäfer
5,279,431 A 1/1994 Highsmith et al.
5,310,066 A 5/1994 Konstant
5,433,152 A 7/1995 Henry
5,529,192 A * 6/1996 Conen ..... A47B 96/028 211/187
5,628,415 A 5/1997 Mulholland
6,006,926 A 12/1999 O'Reilly et al.
6,021,908 A * 2/2000 Mathews ..... A47F 3/0443 211/175
6,105,798 A 8/2000 Gruber et al.
6,257,425 B1 7/2001 Liu
6,257,427 B1 7/2001 Schneid
6,705,477 B1 * 3/2004 Narkis ..... A47B 57/588 211/153
7,478,731 B1 * 1/2009 Mason ..... A47F 1/126 211/59.3
7,784,413 B2 8/2010 Gabriel et al.
7,810,487 B2 10/2010 Johnston
8,141,723 B2 3/2012 Whalen et al.
8,517,191 B2 * 8/2013 Paeth ..... A47B 57/588 211/184
9,027,767 B2 5/2015 Buckley et al.
9,375,102 B2 6/2016 Troyner et al.
9,538,859 B1 * 1/2017 Johnson ..... A47F 11/10
10,123,637 B1 11/2018 DeSena et al.
10,206,506 B1 2/2019 Lai et al.
10,334,970 B2 7/2019 Buck et al.
10,441,094 B2 * 10/2019 Kim ..... B65G 1/026
D875,448 S 2/2020 Reinhart et al.
10,709,238 B1 7/2020 Thompson
11,246,396 B2 2/2022 Boos
11,268,284 B2 3/2022 Ohrstrom
11,304,546 B1 4/2022 Boos
11,389,015 B2 7/2022 Smedley et al.
11,583,110 B2 * 2/2023 Smedley ..... A47F 5/103
11,612,245 B2 3/2023 Meiser
12,053,106 B2 * 8/2024 Smedley ..... A47B 96/028
2007/0221103 A1 * 9/2007 Trausch ..... A47B 57/045 108/108
2009/0107941 A1 4/2009 Liao
2010/0065523 A1 3/2010 Northrup, Jr. et al.
2010/0133219 A1 6/2010 Sun
2011/0147323 A1 * 6/2011 Sainato ..... A47F 1/12 40/642.02
2012/0285915 A1 11/2012 O'Quinn et al.
2014/0263128 A1 9/2014 Garrett et al.
2016/0106235 A1 4/2016 Mason
2018/0360236 A1 * 12/2018 Kim ..... A47F 1/04
2019/0116977 A1 4/2019 Lindblom et al.
2019/0387902 A1 12/2019 Peck et al.
2024/0349913 A1 * 10/2024 Smedley ..... A47F 5/0018

* cited by examiner

RETAIL SHELVING SYSTEM

CROSS-REFERENCE TO RELATED PATENT APPLICATIONS

This patent application is a Continuation of co-pending U.S. patent application Ser. No. 17/826,769, filed May 27, 2022, which is now pending, which is a Continuation of co-pending U.S. patent application Ser. No. 16/222,722, filed Dec. 17, 2018, which issued as U.S. Pat. No. 11,369,215 on Jun. 28, 2022, the entire teachings and disclosure of all applications are incorporated herein by reference thereto.

FIELD OF THE INVENTION

This invention generally relates to retail displays, and more particularly to retail shelving systems.

BACKGROUND OF THE INVENTION

Retail shelving is a staple in the retail merchandise environment. While such shelving comes in many forms, it generally includes a vertical support structure which supports one or more shelves extending outwardly from the vertical structure. The vertical structure is typically a wall-like structure and contains integrated mounting rails, referred to in in the industry as gondola uprights, which the shelves mount to. However, the vertical structure and its gondola uprights offer minimal customization for mounting the shelves in a variety of arrangements.

Further, certain retail displays may not include their own integrated gondola uprights. For non-limiting example, a refrigerated case for containing produce may not have integrated gondola uprights for a variety of reasons, one being that it may not have been originally designed to incorporate gondola mounted shelves, another being that such cases are typically designed to only accept the case manufacturers shelving and thus does not offer any customization.

In such an instance, a separate grid structure that may contain gondola uprights is first mounted to a back wall of the refrigerated case. Thereafter, shelving can be mounted to this grid structure, ultimately to present a shelving arrangement similar to that for displaying non-refrigerated items. While such a configuration has a distinct advantage of allowing the retailer to introduce a shelving arrangement in a display not originally designed for shelving, it is not without its drawbacks.

Indeed, the grid structure is a relatively large welded structure. Because it is welded, shipping this large structure in its pre-assembled state can be costly and cumbersome. Further, because the grid structure is a welded structure, its gondola uprights are fixed. Such grid systems typically include five fixed gondola uprights. However, the particular shelving configuration selected by the end user may necessitate the use of less than all five gondola uprights, leaving the remaining gondola uprights unused yet part of the assembly. Furthermore, the welding process necessitate the use of robust materials, which in turn results in a relatively heavy structure that tends to be difficult to install.

Yet further, the shelves of such shelving systems also present several drawbacks. These shelves are typically steel structures which can corrode over time and which are heavy making them difficult to remove for cleaning. One alternative has been to utilize aluminum shelving instead, but this material results in a more costly system. Also, such steel or aluminum shelves do not meet the requirements for NSF Certification by NSF International, which is a highly desired certification in certain retail display applications in which the shelving surface comes into direct contact with the product being merchandised.

Accordingly, there is a need in the art for a retail shelving system which addresses the above drawbacks of existing shelving systems. The invention provides such a retail shelving system. These and other advantages of the invention, as well as additional inventive features, will be apparent from the description of the invention provided herein.

BRIEF SUMMARY OF THE INVENTION

In one aspect, the invention provides shelving system. An embodiment of such a shelving system includes an upper rail defining an upper channel. The upper rail is configured to mount to a support structure. This embodiment also includes at least one upright support. The at least one upright support has an upper end and a lower end. The upper end is received in the upper channel. The lower end is received in the lower channel. The at least one upright support is slidable in the upper channel. This embodiment also includes at least one shelf mounted to the at least one upright supports.

In embodiments according to this aspect, the upper rail includes a mounting shelf. The at least to upright supports include a channel for receiving the mounting shelf.

In embodiments according to this aspect, the shelving system also includes a lower rail defining a lower channel configured to mount to the support structure separately from the upper rail. The lower rail includes a bottom wall and a lip depending upwardly from the bottom wall which bound the lower channel. The lip of the lower rail includes at least one access opening. The at least one access opening allowing access through the lip of the lower rail to the lower channel. The lower end of the at least one upright support is received in the lower channel.

In embodiments according to this aspect, the upper rail includes an upper wall and a lip depending downwardly from the upper wall which bound the upper channel. An extension length of the lip of the upper rail from the upper wall is less than an extension length of the lip of the lower rail from the lower wall.

In embodiments according to this aspect, each of the upper and lower rails includes a pair of mounting structures for mounting the upper and lower rails to the support structure. Each of the pair of mounting rails includes a front plate and a back plate, the back plate slidable relative to the front plate.

In embodiments according to this aspect, the at least one upright support includes first and second upright supports, and the shelf includes a first and a second support arm. The first support arm is mounted to one of the first and second upright supports. The second support arm is mounted to the other one of the first and second upright supports. The first and second support arms are arranged in opposed spaced relation to one another. A front support bar extends between the first and second support arms. A rear support bar extends between the first and second support arms. At least one deck panel is supported by the front and rear support bars. The at least one deck panel is configured to interlock with an adjacent deck panel such that the at least one deck panel is prevented from laterally moving relative to the adjacent deck panel along the front and rear support bars.

In embodiments according to this aspect, the front and rear support arms each include a front mounting post and a rear mounting post. The front support bar includes a channel. The channel of the front support bar receives the front mounting posts of the first and second support arms such that the front support bar is selectively removable from the first and second support arms. The rear support bar also includes a channel. The channel of the rear support bar receives the rear mounting posts of the first and second support arms such that the rear support bar is selectively removable from the first and second support arms.

In embodiments according to this aspect, the at least one deck panel includes a plurality of tabs extending from a bottom surface of the deck panel. The plurality of tabs are configured to be received in corresponding openings of the adjacent deck panel. The at least one deck panel includes a lip that provides a plurality of openings for receiving a plurality of tabs of the adjacent deck panel.

In another aspect, the invention provides a modular shelf for a shelving system. The shelving system includes at least one rail configured to mount to a support structure, and at least one upright support extending from the at least one rail. The shelf includes a first and a second support arm arranged in opposed spaced relation to one another. At least one support bar is mounted to the first and second support arms. This embodiment of the shelf also includes at least one deck panel supported by the at least one support bar. The at least one deck panel is configured to interlock with an adjacent deck panel such that the at least one deck panel is prevented from laterally moving relative to the adjacent deck panel along the front and rear support bars.

In embodiments according to this aspect, the at least one deck panel includes an integrated baffle support and a plurality of tabs extending from a bottom surface of the deck panel. The plurality of tabs are configured to be received in corresponding openings of the adjacent deck panel. The at least one deck panel also includes a lip providing a plurality of openings for receiving a plurality of tabs of the adjacent deck panel.

In embodiments according to this aspect the at least one support bar includes front and rear support bars. Each of the front and rear support bars include a channel. The channel of the front support bar receives front mounting posts of the first and second support arms such that the front support bar is selectively removable from the first and second support arms. The channel of the rear support bar receives rear mounting posts of the first and second support arms such that the rear support bar is selectively removable from the first and second support arms In embodiments according to this aspect, the at least one deck panel includes a honeycomb structure having at least one channel for receiving the at least one support bar. The at least one channel includes a plurality of finger tabs for affixing the at least one deck panel to the at least one support bar.

In another aspect, the invention provides a shelving system. An embodiment of such a shelving system includes an upper rail configured to mount to a support structure, a lower rail configured to mount to a support structure, and at least two upright supports extending between the upper and lower rails. This embodiment also includes at least one shelf mounted to the at least two upright supports. The at least one shelf comprising a first and a second support arm. Each of the first and second support arms includes a front mounting post and a rear mounting post. This embodiment of a shelf also includes a front support bar extending between the first and second support arms. The front support bar includes a channel. The channel of the front support bar receives the front mounting posts of the first and second support arms such that the front support bar is selectively removable from the first and second support arms. This embodiment also includes a rear support bar extending between the first and second support arms. The rear support bar includes a channel. The channel of the rear support bar receives the rear mounting posts of the first and second support arms such that the rear support bar is selectively removable from the first and second support arms. This embodiment of a shelf also includes at least one deck panel supported by the front and rear support bars.

In embodiments according to this aspect, the upper rail includes an upper channel, and the lower rail includes a lower channel. Each of the at least two upright supports has an upper end and a lower end. The upper end is received in the upper channel, and the lower end is received in the lower channel. The at least two upright supports are slidable in the upper and lower channels.

In embodiments according to this aspect, the at least one deck panel is configured to interlock with an adjacent deck panel. The at least on deck panel includes a front and a rear channel for receiving the front and rear support bars, respectively.

In embodiments according to this aspect, the at least one deck panel includes opposed side edges A plurality of tabs extend from a bottom surface adjacent one of the opposed side edges of the deck panel. The at least one deck panel includes a lip adjacent the other one of the opposed side edges. The lip provides a plurality of openings for receiving a plurality of tabs of the adjacent deck panel.

In another embodiment, the invention provides a method of installing a shelving system. An embodiment of such a method includes mounting an upper rail having an upper channel to a support structure, mounting at least one upright support having an upper end and a lower end to the upper rail such that the upper end of the first upright support is disposed within the upper channel, mounting a first support arm of a at least one shelf to the at least one upright support, mounting a second support arm of the at least one shelf to the at least one upright support, situating at least one support bar such that it extends between the first and second support arms, and affixing a first deck panel onto the at least one support bar.

In embodiments according to this aspect, the step of mounting the at least one upright support includes mounting a first and a second upright support to the upper rail, and further includes linearly inserting the upper end of each of the first and second upright supports into the upper channel, and sliding the first and second upright supports into first and second positions, respectively.

In embodiments according to this aspect, the method also includes separately mounting a lower rail having a lower channel to the support structure below the upper rail. Mounting the at least one upright support includes mounting the at least one upright support to the upper and lower rails such that the upper end is received in the upper channel and the lower end is received in the lower channel. The method also includes rotating the at least one upright support such that the lower end thereof passes through an opening in the lower mounting rail to seat within the lower channel.

In embodiments according to this aspect, the step of situating the at least one support bar includes situating front and rear support bars on a mounting post of each support arm within a channel of each support bar.

In embodiments according to this aspect, the method also includes affixing a second deck panel onto the at least one support bar such that the first and second deck panels interlock.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Turning now to the drawings, the same illustrate an embodiment of a shelving system according to the teachings herein. As will be understood from the following, the shelving system provides several advantages over existing designs. First, it utilizes an upper rail and a lower rail which are separately mountable from one another. A number of upright supports are slidably received by these upper and lower rails. As a result, an installer can easily mount the upper rail, then mount the lower rail, and then slide the upright supports into the rails. This is a distinct departure from prior designs which employ a grid structure that is welded together as a one piece unit.

Second, the shelving system according to the teachings herein utilizes shelves which may be assembled onto the upright supports once they are installed. This is a distinct advantage over prior designs which require lifting a shelf as a unit onto a grid structure. Instead, according to the teachings herein, the shelf is rapidly assembled piece by piece in place. As a result, relatively light parts are lifted during installation, which are also far less cumbersome. Third, the shelf or shelves of the current application utilize plastic deck panels which may be formed of a NSF compliant material. Fourth, because both the rails, the upright supports, and shelf or shelves are designed to be assembled during installation, they may be shipped in a much smaller container than in prior designs. Fifth, due to the size and modular nature of the deck panels, these panels may be easily removed for cleaning in a sink or dishwasher. This is a distinct advantage over prior designs, which require removing the entirety of the shelf as a single unit and washing the same in a cleaning area which accommodates cleaning of relatively large objects. These and other advantages will become more apparent from the disclosure herein.

Figure 1:
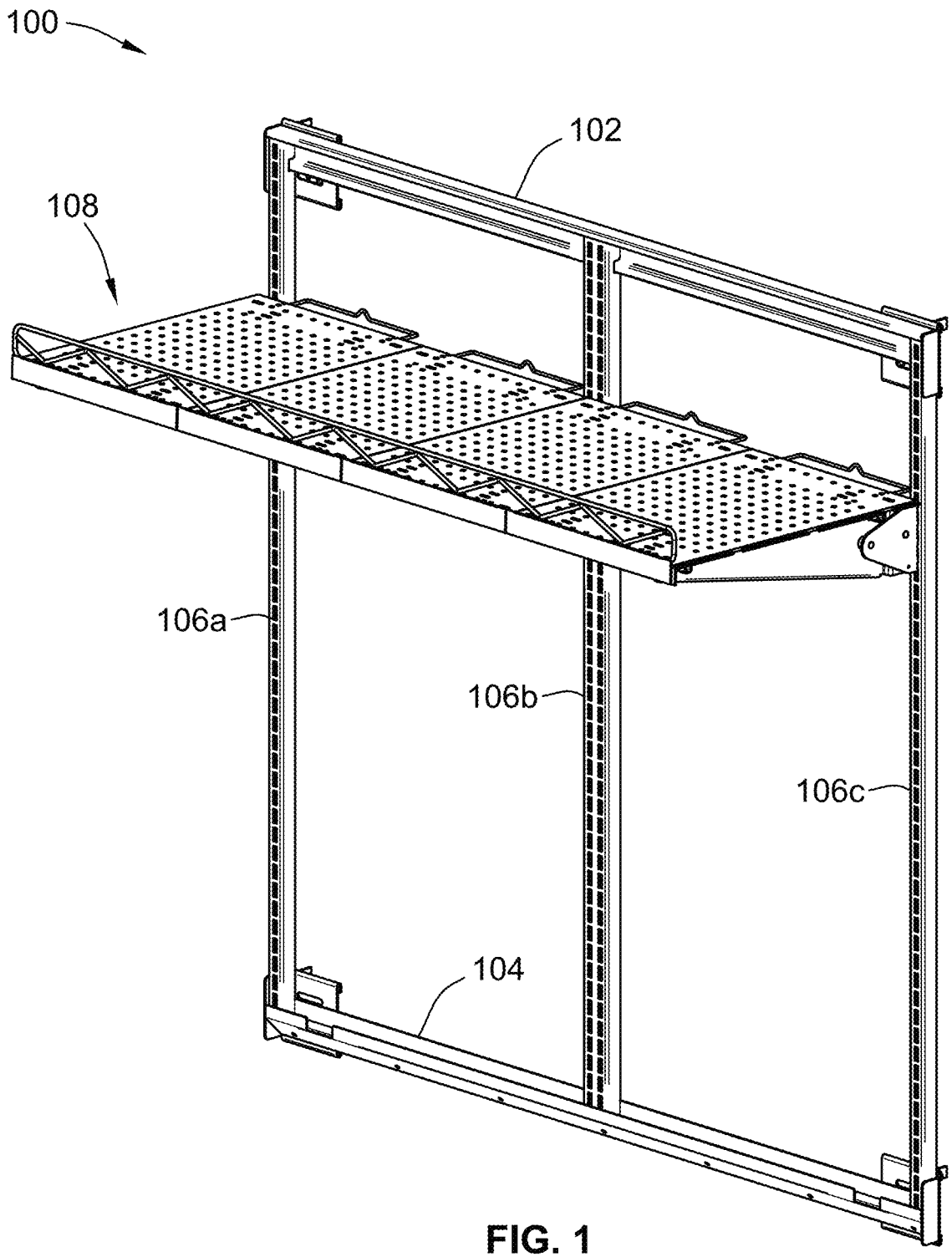
FIG. 1 is a perspective view of an exemplary embodiment of a retail shelving system according to the teachings herein.

With specific reference now to FIG. 1, the same illustrates an exemplary embodiment of a shelving system 100 according to the teachings herein. Shelving system 100 includes a grid assembly with one or more shelves 108 mounted thereto. While one shelf 108 is shown, it is contemplated that any number of shelves may be mounted to this grid assembly. Further, while shelf 108 illustrated the full length of the grid assembly, shorter shelf lengths are entirely possible due to the highly customizable nature of the grid assembly and through the use of a common and modular deck panel as discussed below.

The grid assembly itself consists of a number of separate and distinct components which will be discussed in turn. As mentioned above, this approach of having separate components has a distinct advantage over grid structures of prior designs which are a welded structure which is relatively large and cumbersome.

The grid assembly includes an upper rail 102 and a separate lower rail 104. Upper and lower rails 102, 104 are configured to mount to a support structure such as a vertical wall, the interior of a refrigerated or freezer case, etc. Indeed, upper and lower rails 102, 104 may be adapted to mount to any structure capable of supporting the same. As such, upper and lower rails 102, 104 may incorporate any mounting expedient.

One advantageous feature of upper and lower rails 102, 104 is that they are separate components. As a result, they may be separately installed to the aforementioned support structure. This makes installation considerably easier than in prior designs which require lifting a large welded grid structure as a single unit and installing it in place on a support structure.

A plurality of upright supports 106*a*, 106*b*, 106*c* are slidably received in upper and lower rails 102, 104. As will be explained below, rails 106*a-c* are used for mounting shelf 108 thereto. It should be noted that three upright supports 106*a-c* are illustrated for purposes of description. However, only the outer most upright supports 106*a*, 106*c* are needed for mounting the illustrated shelf 108. Multiple additional shelves 108 may mount to the same two upright supports 106*a*, 106*c* below shelf 108 as illustrated. Further, shelves 108 having a shorter length may be mounted between upright supports 106*a* and 106*b*, or between upright supports 106*b* and 106*c*. Unless otherwise specifically noted herein, any description of the structure, function, or use of one upright support 106*a-c* applies equally to the others.

One advantage having separate upright supports 106*a-c* is the ability to add or remove a desired number of upright supports as discussed below to allow for a specific shelving configuration. This is a distinct departure from prior welded designs as discussed above. In such welded designs, a fixed number of upright supports are provided, making customization difficult. The number of upright supports which may be included in the current application will be entirely dependent upon the shelving configuration desired. Therefore, the three upright supports 106*a-c* should be taken as only one of many possible examples. While two rails 102, 104 are shown and described, it is contemplated that only a single upper rail 102 could be utilized for receiving and supporting upright supports 106*a-c*.

Figure 2:
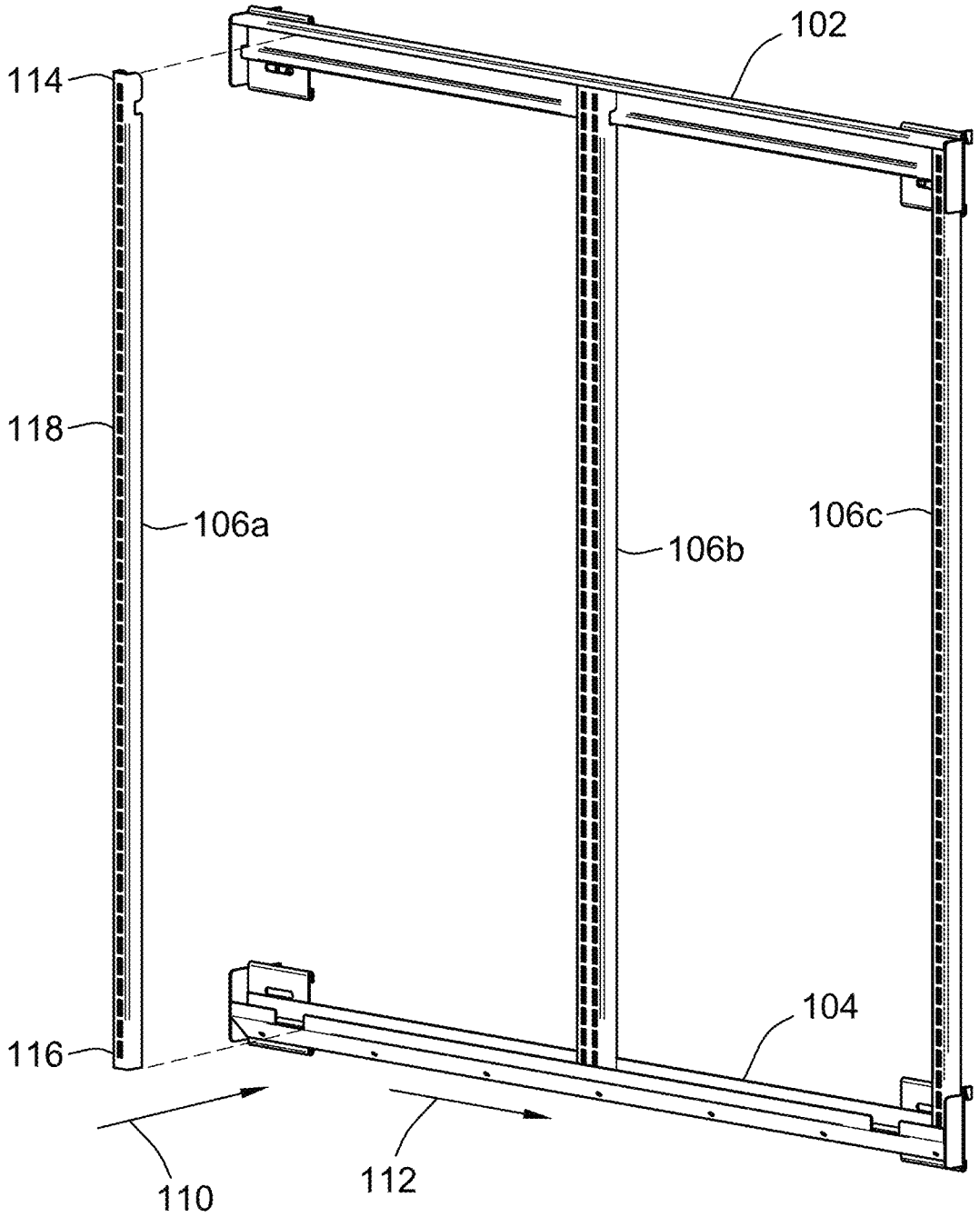
FIG. 2 is a perspective exploded view of a grid assembly of the retail shelving system of FIG. 1.

Turning now to FIG. 2, once upper and lower rails 102, 104 are installed, each upright support 106*a-c* is installed by generally situating the upright supports 106*a-c* into upper and lower rails 102, 104 by moving them generally in direction 110, and then sliding them in direction 112 to their final destinations. Upper and lower rails 102, 104 are designed such that they each include a channel within which the end portions of the upright supports 106*a-c* are situated and slidable in.

Indeed, referring specifically to upright support 106*a* shown in FIG. 2, the same includes an upper end 114 and a lower end 116. A plurality of apertures 118 are formed therein for shelf mounting. These apertures 118 may take on any shape. An identical description to that of upright support 106*a* applies to 106*c*. Upright support 106*c* differs only in that it include two parallel rows of apertures 118 as illustrated.

Figure 3:
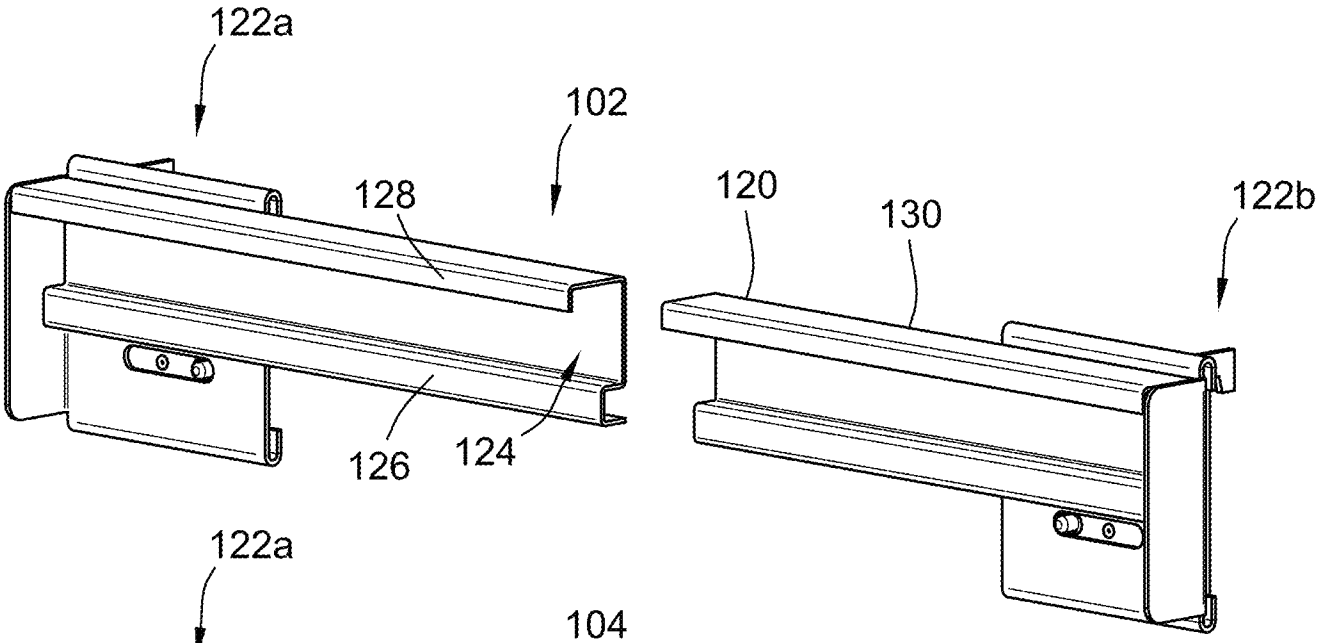
FIG. 3 is a perspective view of an upper rail of the grid assembly of FIG. 2.

Turning now to FIG. 3, the same illustrates upper rail 102. Upper rail 102 includes a rail section 120 with a pair of identical mounting brackets 122*a*, 122*b* at opposed ends of rail section 120. Rail section 120 includes a channel 124 within which the upper end 114 of each upright support 106*a-c* is slidable. Further, rail section 120 also includes a mounting shelf 126 upon which each upright support 106*a-c* mates. This configuration ensures that upright supports 106*a-c* are at a uniform height relative to one another so that the apertures 118 horizontally align.

Rail section 120 includes a lip 128 which depends downwardly from an upper wall 130 of rail section 120. This lip 128, upper wall 130, and mounting shelf 126 bound channel 124. The particular length of upper rail 102 shown should be taken by way of example only. Indeed, the length of upper rail 102 may be varied depending upon the desired sizing of shelving system 100.

Figure 4:
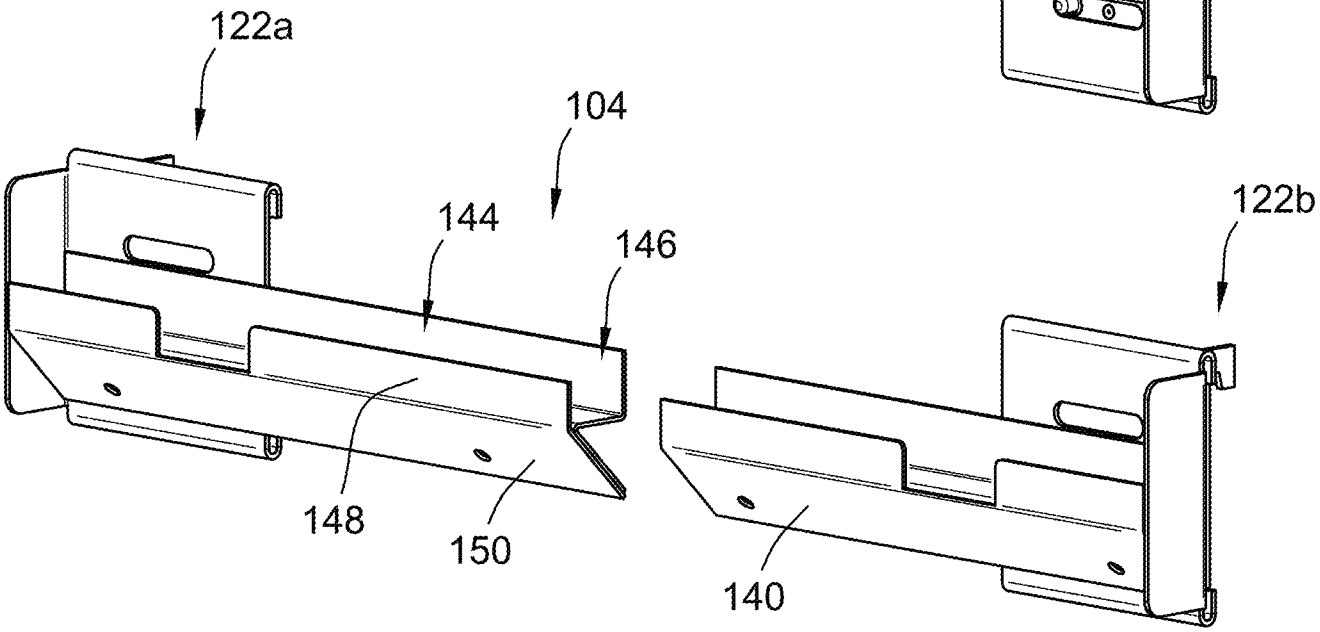
FIG. 4 is a perspective view of a lower rail of the grid assembly of FIG. 2.

Turning now to FIG. 4, the same illustrates lower rail 104. Lower rail 104 also includes a rail section 140. The same pair of identical mounting brackets 122*a*, 122*b* used in upper rail 102 (see FIG. 3) are also used in lower rail 104 as shown. Rail section 140 also includes a channel 144 within which the lower end 116 of each upright support 106*a-c* is slidable. An opening 146 is formed in rail section 140. This opening 146 allows passage of lower end 116 (see FIG. 2) of each upright support 106*a-c* from an exterior of rail section 140 into channel 144 as discussed below.

Rail section 140 includes a lip 148 which depends upwardly relative to a lower wall 150 of rail section 140. This lip 148 and lower wall 150 bound channel 144. The particular length of lower rail 104 shown should be taken by way of example only. Indeed, the length of lower rail 104 may be varied depending upon the desired sizing of shelving system 100. Further, lip 148 retains lower end 116 of upright supports 106*a-c* when situated in channel 144, preventing them from rocking away from a support structure upon which rails 102, 104 are mounted.

Figure 5:
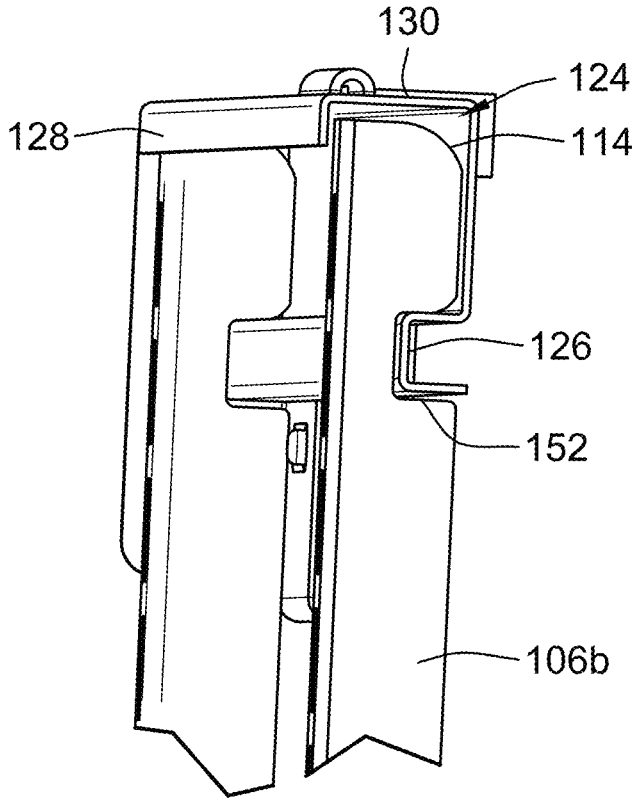
FIG. 5 is a perspective cross section of the grid assembly of FIG. 2, taken in a region of the upper rail.

Turning now to FIG. 5, the same illustrates a cross section in the region of the upper end 114 of upright support 106*b* when it is situated within channel 124. As may be seen in this view, upper end 114 closely resembles the shape of channel 124 to minimize relative movement between these structures. As may also be seen in this view, upright supports 106*a-c* each include a channel 152 which receives mounting shelf 126 as shown.

Figure 6:
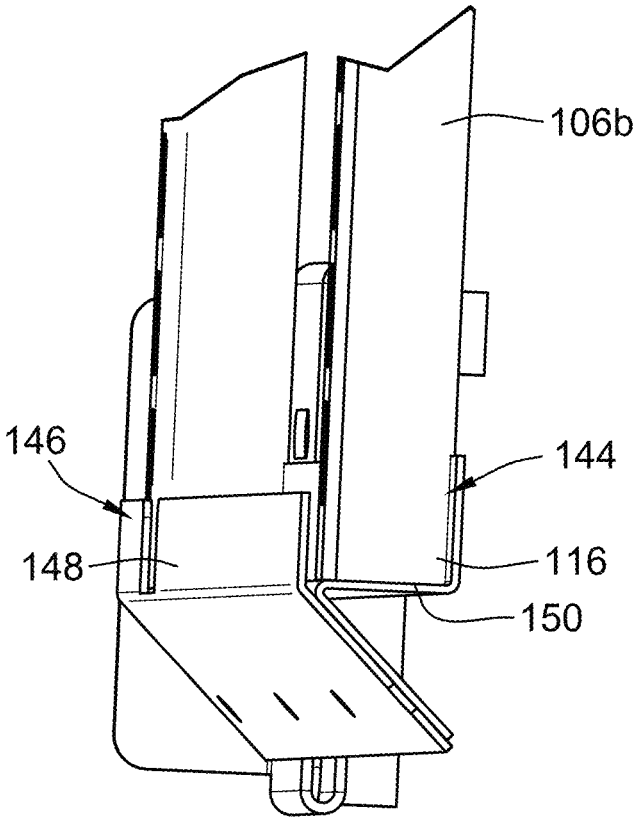
FIG. 6 is a perspective cross section of the grid assembly of FIG. 2, taken in a region of the lower rail.

Likewise, and as is shown in FIG. 6, lower end 116 closely resembles the shape of channel 144 to minimize relative movement between these structures. Lower end 144 may rest on bottom wall 150 as shown, or it may be spaced away from bottom wall 150. Indeed, the support provided by mounting shelf 126 (see FIG. 5) is sufficient to allow upright supports 106*a-c* to hang freely therefrom.

Figure 7:
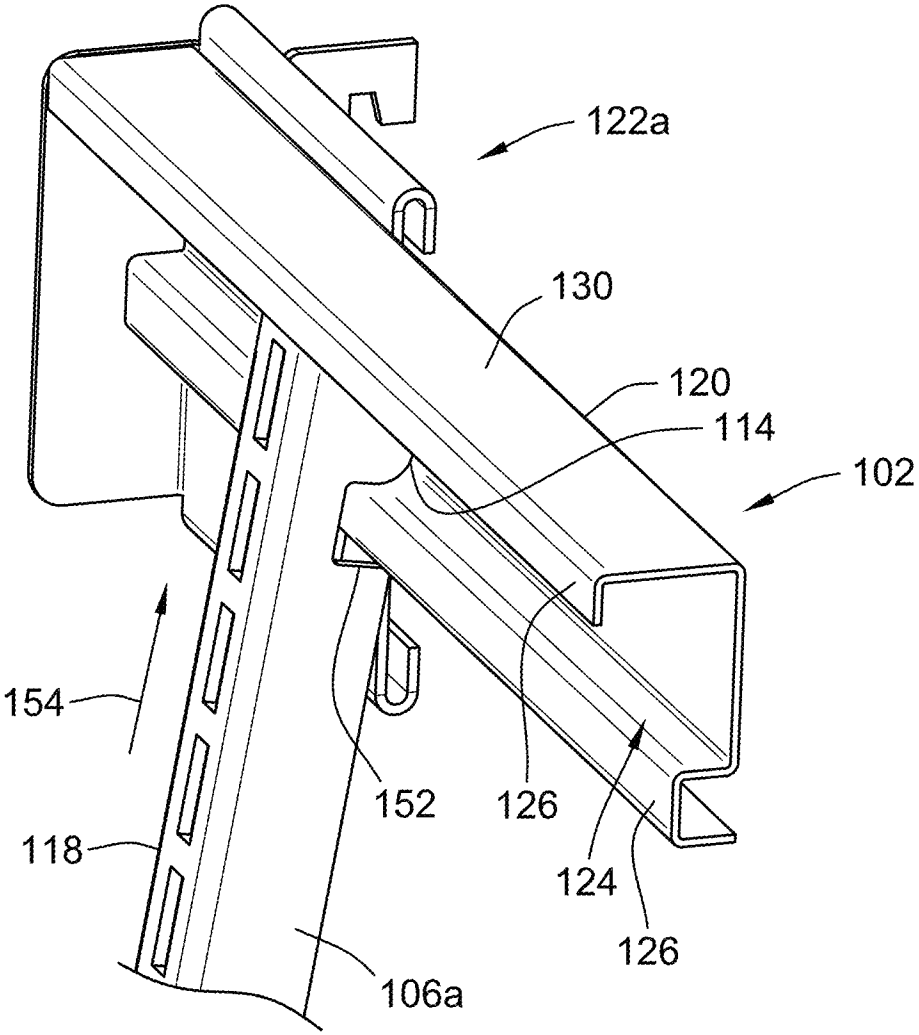
FIG. 7 is a perspective view of the upper rail of the grid assembly of FIG. 2 receiving an upper end of an upright support.
Figure 8:
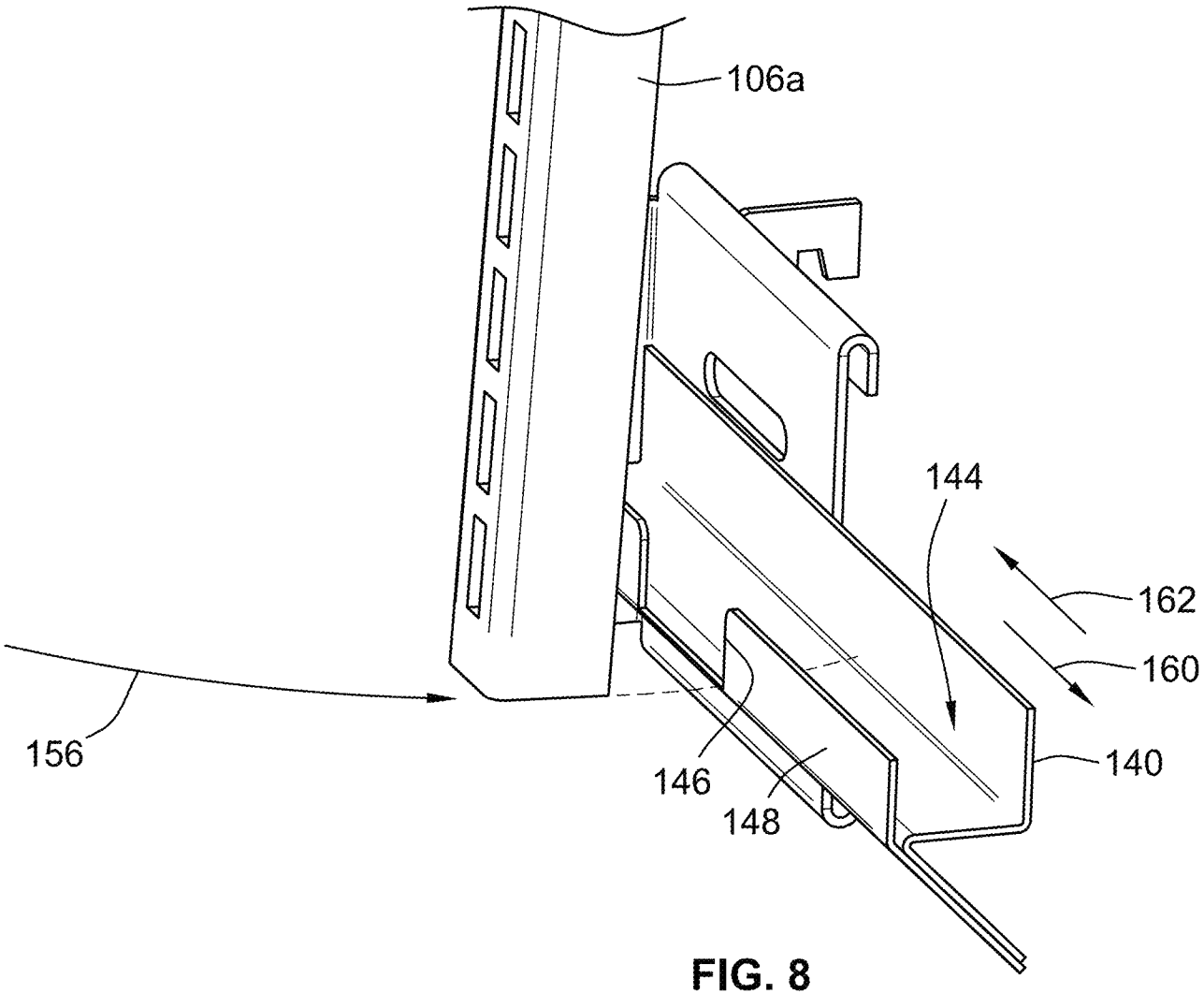
FIG. 8 is a perspective view of the lower rail of the grid assembly of FIG. 2 receiving a lower end of the upright support depicted in FIG. 7.

FIGS. 7 and 8 illustrate a typical installation operation of uprights supports 106*a-c*. As shown in FIG. 7, upright support 106*a* is brought into proximity with upper rail 102 and angled as shown. Upright support 106*a* is then moved in linear direction 154 as shown until upper end 114 is partially situated within channel 124. Thereafter, and referring now to FIG. 8, upper rail is then rotated about its upper end 114 to pivot lower end 116 in direction 156 as shown. Doing so causes lower end 116 to pass through aperture 146 in rail section 140 of lower rail 104. This operation ultimately places lower end within channel 144. Once within channels 124, 144, upright support 106*a* may be slid in directions 160, 162 to its desired location. A successive operation as described above is undertaken for each upright support installed in upper and lower rails 102, 104. It is also contemplated that the above process could be reversed relative to upper and lower rails 102, 104. Indeed, upright supports 106*a-c* could be installed into lower rail 104 first in the same manner as they are installed into upper rail 102 described above, and then installed into upper rail 102 in the same manner as they are installed into lower rail as described above. It is thus contemplated that the structure and function of upper and lower rails 102, 104 could be swapped.

Figure 9:
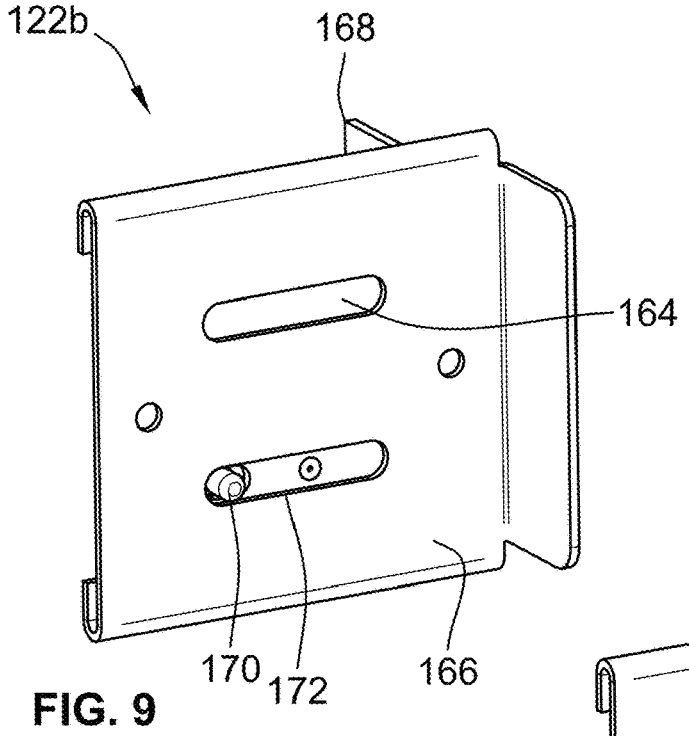
FIG. 9 is a perspective view of a mount of the grid assembly of FIG. 2.

Turning now to FIG. 9, the same illustrates an exemplary view of mounting bracket 122*b*. As noted above, mounting bracket 122*b* is identical to mounting bracket 122*a*. Mounting bracket 122*b* includes a movable plate 164 providing mounting features 168 for mounting to a support structure, and a fixed plate 166. Fixed plate 166 is fixed to its associated rail section 120, 140, while movable plate 164 is slidable relative to fixed plate 166. Movable plate 164 includes a pin 170 which is received in a slot 172 of fixed plate 166.

Figure 10:
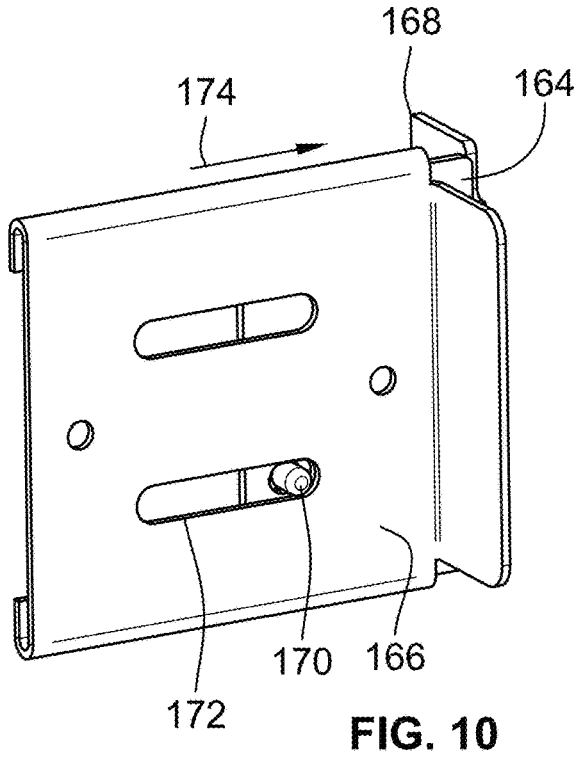
FIG. 10 is another perspective view of the mount of FIG. 9, shown in an alternate position.
Figure 11:
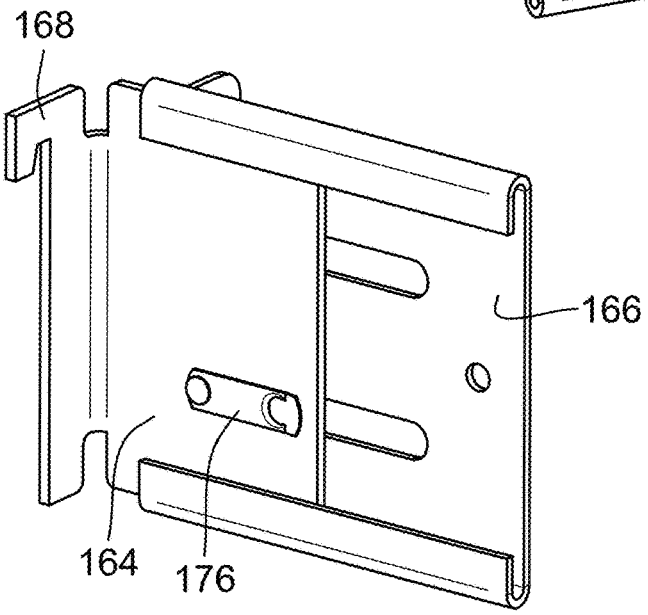
FIG. 11 is another perspective view of the mount of FIG. 9, showing a side thereof opposite that shown in FIG. 9.

Turning now to FIG. 10, this pin and slot configuration defines the amount of lateral travel movable plate 164 may undergo relative to fixed plate 166 before movable plate 164 is effectively separated from fixed plate 166. As an example in FIG. 10, movable plate 164 has moved in direction 174 relative to fixed plate 166. Such a slidable configuration allows the mounting brackets 122*a*, 122*b* to accommodate for deviations in corresponding mounting holes in a support structure arranged to receive mounting features 168. With momentary reference to FIG. 11, pin 170 attached to movable plate 164 via a leave spring 176 which may be deflected to such an extent to allow for full separation of movable plate 164 from fixed plate 166.

Figure 12:
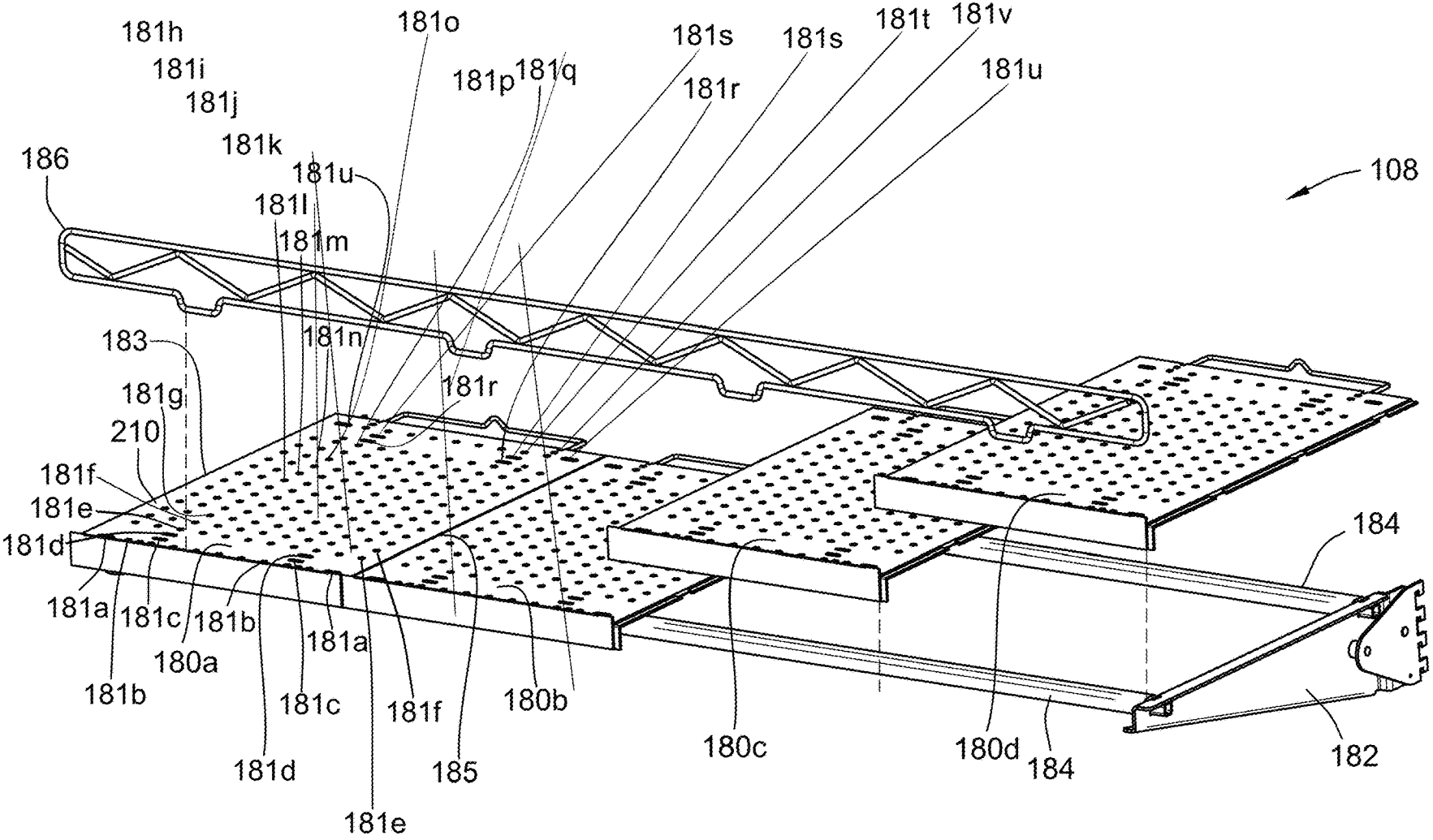
FIG. 12 is a perspective partially exploded view of a shelf of the shelving system of FIG. 1.

Turning now to FIGS. 12-19, the same illustrate shelf 108 in greater detail. With particular reference to FIG. 12, shelf 108 includes a plurality of identical deck panels 180*a*, 180*b*, 180*c*, 180*d*. Given that deck panels 180*a-d* are identical, a description of any of one of said deck panels 180*a-d* applies equally well to the others. Although four deck panels 180*a-d* are shown to accommodate for the full length of shelf 108 illustrated, shorter shelves 108 will have fewer deck panels. For example, a shelf 108 half as long as that illustrated in FIG. 12 would only have two deck panels. Further, it is also contemplated that a shelf 108 may include a single deck panel. As will be discussed below, where multiple deck panels 180*a-d* are utilized, adjacent deck panels interlock with one another to prevent lateral movement of these deck panels 180*a-d* relative to one another. As one non-limiting example, each deck panel 180*a-d* may be one foot wide. A four foot long shelf would thus employ four deck panels. Although illustrated as mounting the grid assembly discussed above relative to FIGS. 1-11, it is contemplated that shelf 108 may be configured to mount to any existing structure by minor modification of the structure it utilizes for mounting. More generally, it is contemplated by the teachings herein, that the invention may be embodied as a combined system as reflected in FIG. 1 for example, or as a stand alone shelf 108 that may be retrofit into an existing system.

Each deck panel 180*a-d* includes an upper surface 210 which is used to support merchandise. Further, deck panels 180*a-d* may include perforations as shown, or any other features typical of retail shelving, e.g. features for mounting a front fence 186 as shown, features for mounting dividers (not shown), a price channel or price channel support 232 (see FIG. 17), channels or other features for receiving and retaining lighting elements, etc. Deck panels 180*a-d* may be formed of a plastic material, for example, an acrylonitrile butadiene styrene (ABS) plastic. Such a material selection allows for the use of NSF certified materials for contacting retail items such as produce or the like.

As noted, each deck panel 180*a*-180*d* is shown with a plurality of perforations, i.e. apertures or rows of apertures. Deck panels 180*a*-180*d* have the same perforations and thus only deck panel 180*a* has been labeled and will be described. Deck panel 180*a* has various apertures arranged in rows of apertures that are spaced between the front and rear of the deck panel 180*a* . A first row is formed by apertures 181*a*. A second row is formed by apertures 181*b*. A third row is formed by apertures 181*c*. A fourth row is formed by apertures 181*d*. A fifth row is formed by apertures 18l*e*. A sixth row is formed by apertures 181*f*. A seventh row is formed by apertures 181*g*. An eight row is formed by apertures 181*h*. A ninth row is formed by apertures 18l*i*. A tenth row is formed by apertures 181*j*. An eleventh row is formed by apertures 181*k*. A twelfth row is formed by apertures 181*l*. A thirteenth row is formed by apertures 181*m*. A fourteenth row is formed by apertures 181*n*. A fifteenth row is formed by apertures 181*o*. A sixteenth row is formed by apertures 181*p*. A seventeenth row is formed by apertures 181*q*. An eighteenth row is formed by apertures 181*r*. A nineteenth row is formed by apertures 181*s*. A twentieth row is formed by apertures 181*t*. A twenty-first row is formed by apertures 181*u*. A twenty-second row is formed by apertures 181v.

Figure 14:
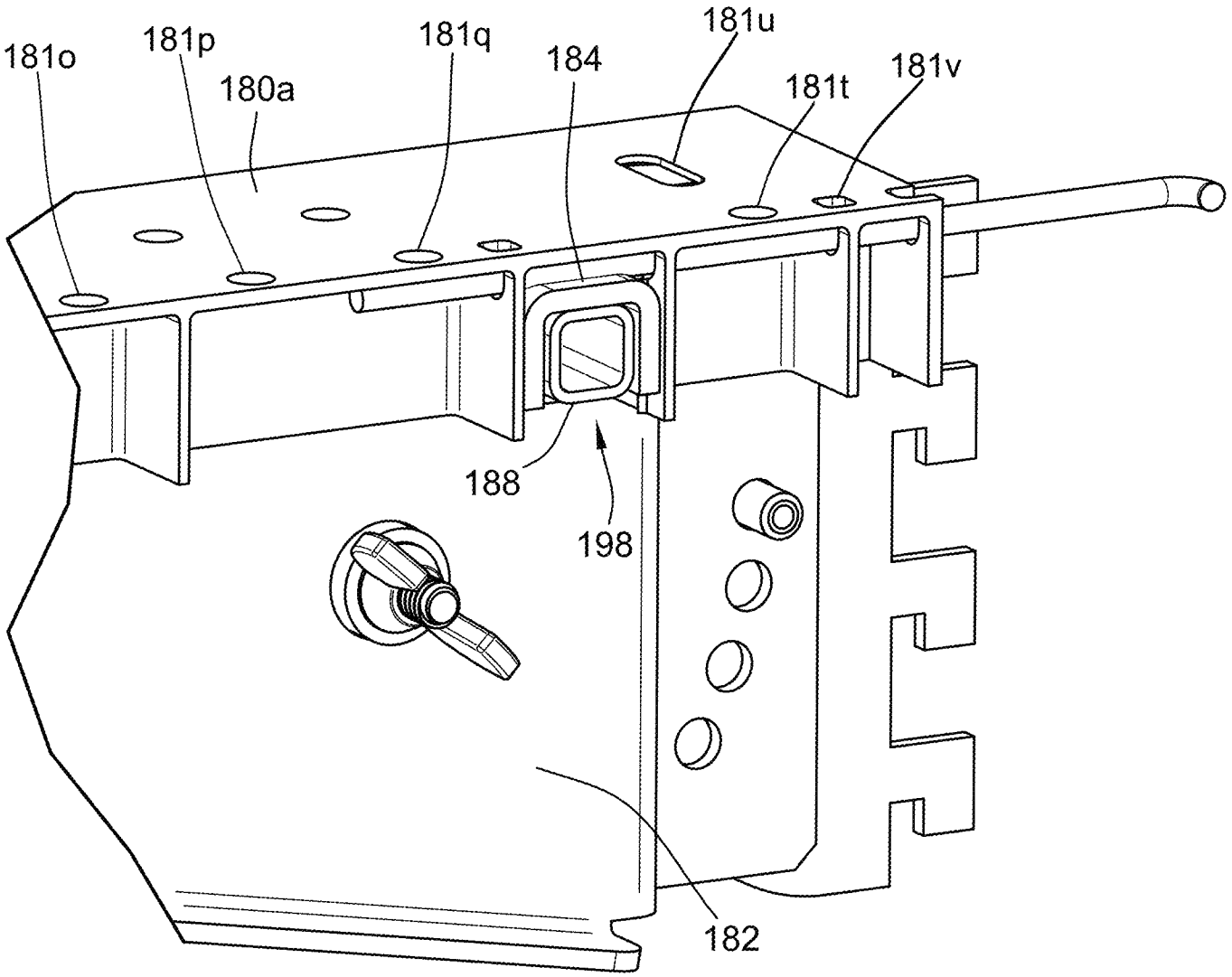
FIG. 14 is a cross section of a portion of the shelf of FIG. 12.
Figure 18:
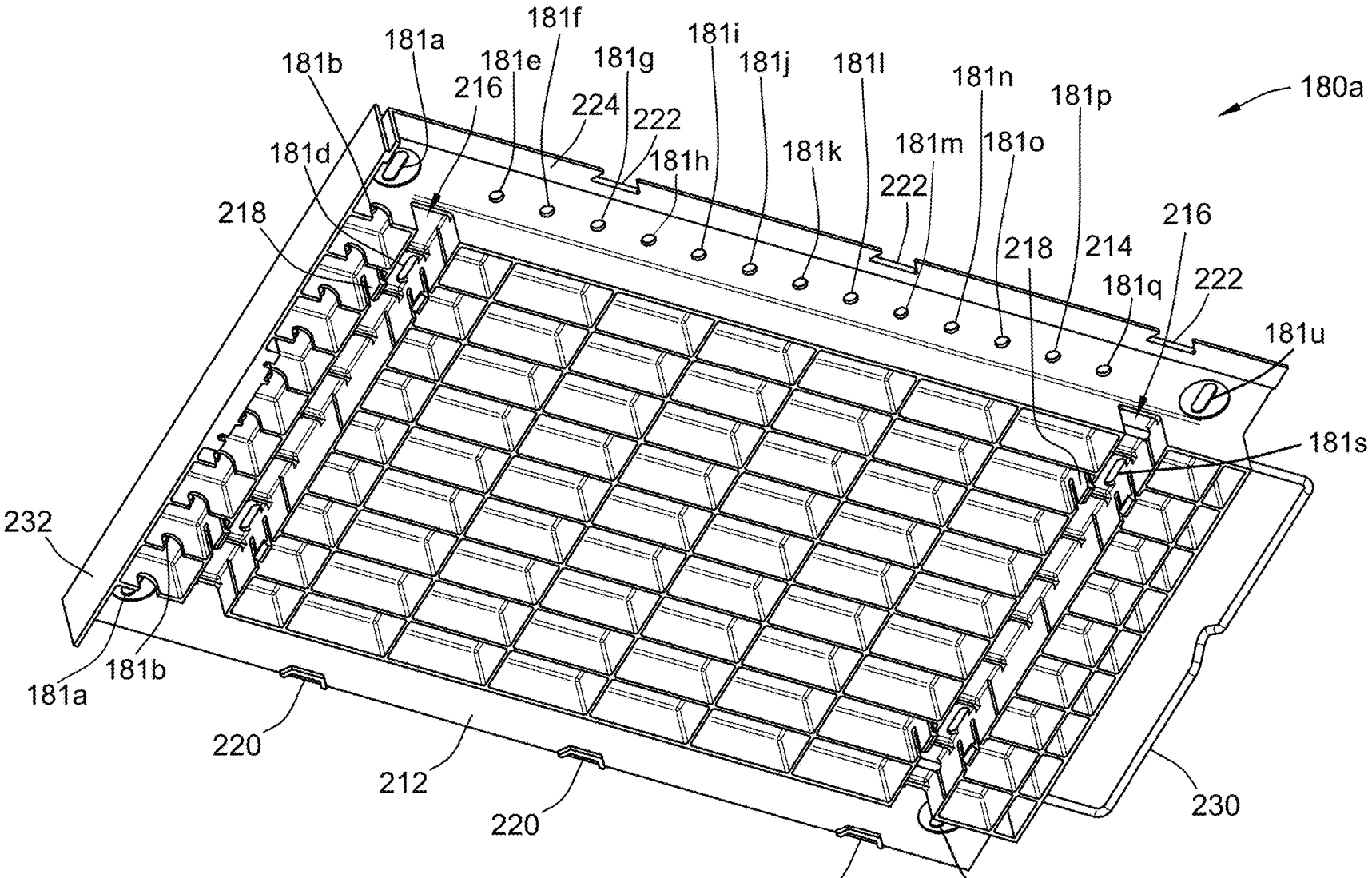
FIG. 18 is a perspective view of a deck panel of the shelf of FIG. 12.
Figure 19:
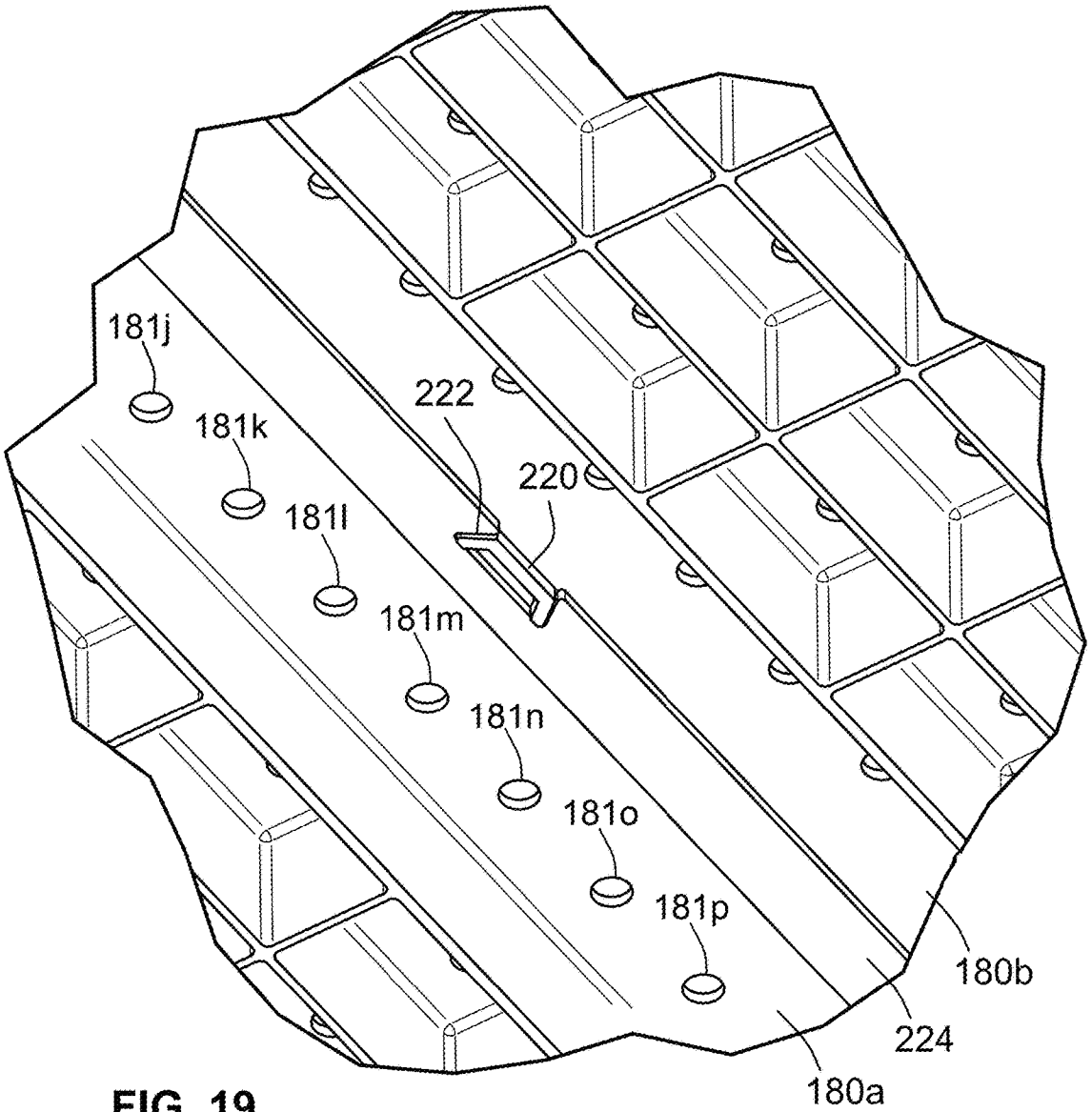
FIG. 19 is perspective view of an overlapped joint formed between adjacent deck panels.

In the illustrated example and with additional reference to FIGS. 14, 18 and 19 along with FIG. 12, some apertures are horizontally elongated such as apertures 181*a* forming the first row, apertures 181*c* forming the third row, apertures 181*d* forming the fourth row, apertures 181*r* forming the eighteenth row, apertures 181*s* forming the nineteenth row, and apertures 181*u* forming the twenty-first row. Other apertures may be circular and are thus not elongated in the horizontal direction, front to rear direction, or any other direction. Some such circular apertures are apertures 181*b*, 181*e*-181*q*, and 181*t*. Other apertures, such as apertures 181*v* are generally square and thus not elongated in the horizontal direction or in the front to rear direction.

Some rows may only have two apertures while other rows may have more than two apertures. For example, there are only two apertures 181*a* in the first row, two apertures 181*c* in the third row, two apertures 181*d* in the fourth row, two apertures 181*r* in the eighteenth row, two apertures 181*s* in the nineteenth row and two apertures 181*u* in the twenty-first row. Other rows such as, for example, rows 181*b*, and 18l*e*-181*q* have more than two apertures per row.

In addition to having different aperture shapes, aperture spacing, and numbers of apertures as illustrated, rows may have different spacing relative to the edges 183, 185 of the deck panel 180*a* . For example, the first row formed from apertures 181*a* has a first aperture 181*a* that is closest to edge 183 that is spaced a first distance from the edge 183 and a last aperture 181*a* that is closest to edge 185 that is spaced a second distance from the edge 185. Whereas the third row formed from apertures 183*c* has a first aperture 181*c* that is closest to edge 183 that is spaced a third distance from the edge 183. This third distance is greater than the first distance that the first aperture 181*a* is spaced from edge 183. The third row has a last aperture 181*c* that is closest to edge 185 that is spaced a fourth distance from edge 185. This fourth distance is greater than the second distance that the last aperture 181*a* is spaced from edge 185. The fourth row formed from apertures 181*d*, eighteenth row formed from apertures 181*r*, and nineteenth row formed from apertures 181*s* have first and last apertures that are similarly farther from edge 183 and 185, respectively, than the first and last apertures of the first row formed from apertures 181*a*. The same spatial configuration of the first and last apertures applies between the row formed by apertures 181*u* and the rows formed by apertures 181*c*, 181*d*, 181*r*, and 181*s*. The third, fourth, eighteenth and nineteenth rows have first apertures that are spaced greater distances from edge 183 than the first apertures of the fifth through seventeenth rows formed by apertures 18l*e*-181*q*. Additionally, the third, fourth, eighteenth and nineteenth rows have last apertures that are spaced greater distances from edge 185 than the last apertures of the fifth through seventeenth rows formed by apertures 181*e*-181*q*.

Further, because deck panels 180*a-d* are separable and removable from the remainder of shelf 108, they may be easily cleaned in a dishwasher, sink, etc. Further, although illustrated as forming a portion of a flat shelf, deck panels 180*a-d* may take on other forms. For example, deck panels 180*a-d* may be embodied as bins or any other expedient typically used in the retail environment for containing merchandise. Yet further, although not illustrated, pusher systems and other front facing devices may be readily mounted to deck panels 180*a-d*.

Still referring to FIG. 12, in addition to deck panels 180*a-d*, shelf 108 includes first and second support arms 182 arranged at opposed sides of shelf 108. Support arms 182 are mirror images of one another, so a description of one applies equally well to the other. Shelf 108 also includes front and rear support bars 184 which are also identical to one another.

Figure 13:
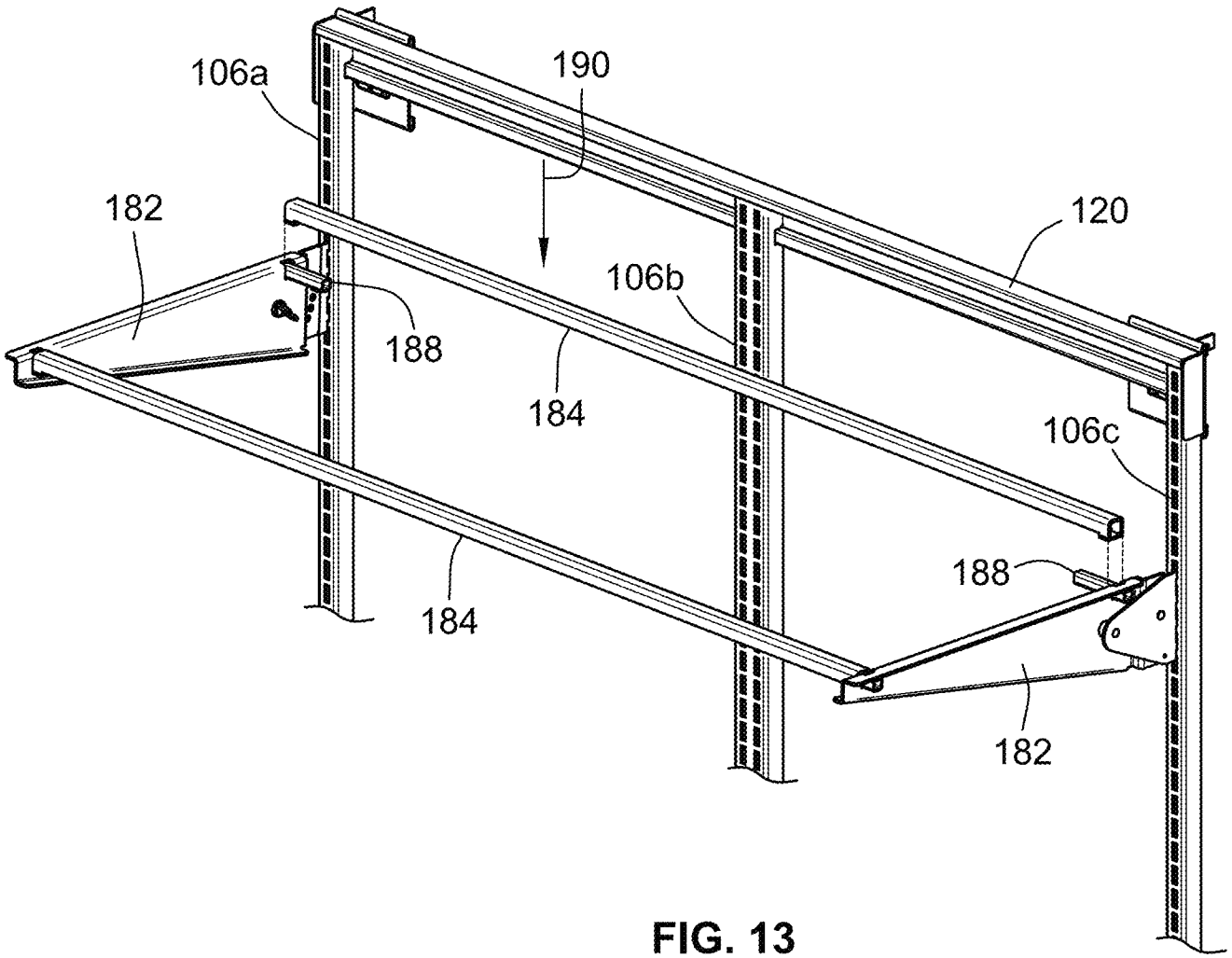
FIG. 13 is another perspective partially exploded view of the shelf of FIG. 12, shown in relation to the grid assembly of FIG. 2.

Turning now to FIG. 13, shelf 108 is rapidly installable to the above described grid assembly by the following general process. First, each support arm 182 is mounted to a respective upright support 106*a-c*. In the illustrated embodiment the left-most support arm 182 is mounted to upright support 106*a*, and the right-most support arm 182 is mounted to upright support 106*c*. Thereafter, each support bar is 184 is installed by moving the same generally in direction 190 until a support post 188 of each support arm 182 is situated within a channel of each support bar 164 as discussed below. Once support bars 184 are in place, each deck panel 180*a-d* is then successively affixed in place to support bars 184 as discussed below.

Alternatively, where support bars 184 are closed profile tubular elements, it is also contemplated that each support bar 184 is installed by horizontally sliding it onto the mounting post 188 of each support arm 182. Such an operation may be done prior to installing support arms 182 onto their associated upright support. Further, although a front and rear support bar 184 are shown, it is contemplated that for deeper shelf lengths, additional support bars 184 intermediate of front and rear support bars 184 could be utilized as well. Likewise, it is also contemplated that shallower shelf depths may only require a single support bar 184. As such, it is contemplated that at least one support bar 184 may be utilized for supporting the deck panel or panels 180*a-d* of shelf 108.

Still further, although shelf 108 is described as mounting to two separate upright supports 106*a*, 106*c*, it is contemplated that shelf 108 may mount to a single upright support. Such a single upright support may be wider than those shown to accommodate mounting multiple support arms 182. For example, shelf 108 may mount to upright support 106*b* alone. Upright support 106*b* includes a double row of apertures 118 and can thus accommodate two support arms. The overall width of such a single upright support 106*b* may be varied to accommodate varying shelf lengths. As such, it is contemplated that at least one upright support is all that is required at a minimum for shelf mounting.

It will be recognized from the foregoing that all of the componentry of shelf 108 may be readily assembled and disassembled without the use of any special tools, or without destroying or disfiguring any portion of shelf 108. Such a configuration is a distinct departure from prior designs which typically employ welded structures for their shelves, making the same heavy and generally cumbersome when the same are installed, or periodically removed for cleaning.

It will also be recognized from the foregoing, that shelf 108 presents a highly modular design. Indeed, as one non-limiting example, shelf 108 may be readily adapted to a shelf having half of the length shown by remounting one of support arms 182 on upright support 106*b*, and utilizing shorter support bars 184. Thereafter, two deck panels (instead of the four shown) can then be snapped onto these shorter support bars 184.

FIG. 14 illustrates a cross section taken in the region of the interface between a mounting post 188 of the left-most support arm 182 shown in FIG. 13 and rear support bar 184. As can be seen in this view, mounting post 188 is situated within a channel 196 of support bar 184. An identical configuration exists at the other end of this support bar 184, as well as at both ends of the front support bar 184 shown in FIG. 13. Each support bar 184 is supported by two mounting posts 188 by resting upon the same, without being permanently attached to these mounting posts 188, and thus presents a selectively removable style of assembly. It is also contemplated that channel 196 of each support bar 184 may be open sided as shown, or may be partially or fully enclosed in the event that support bars 184 are partially or entirely tubular elements, as opposed to having a generally U-shaped cross section as shown.

Figure 15:
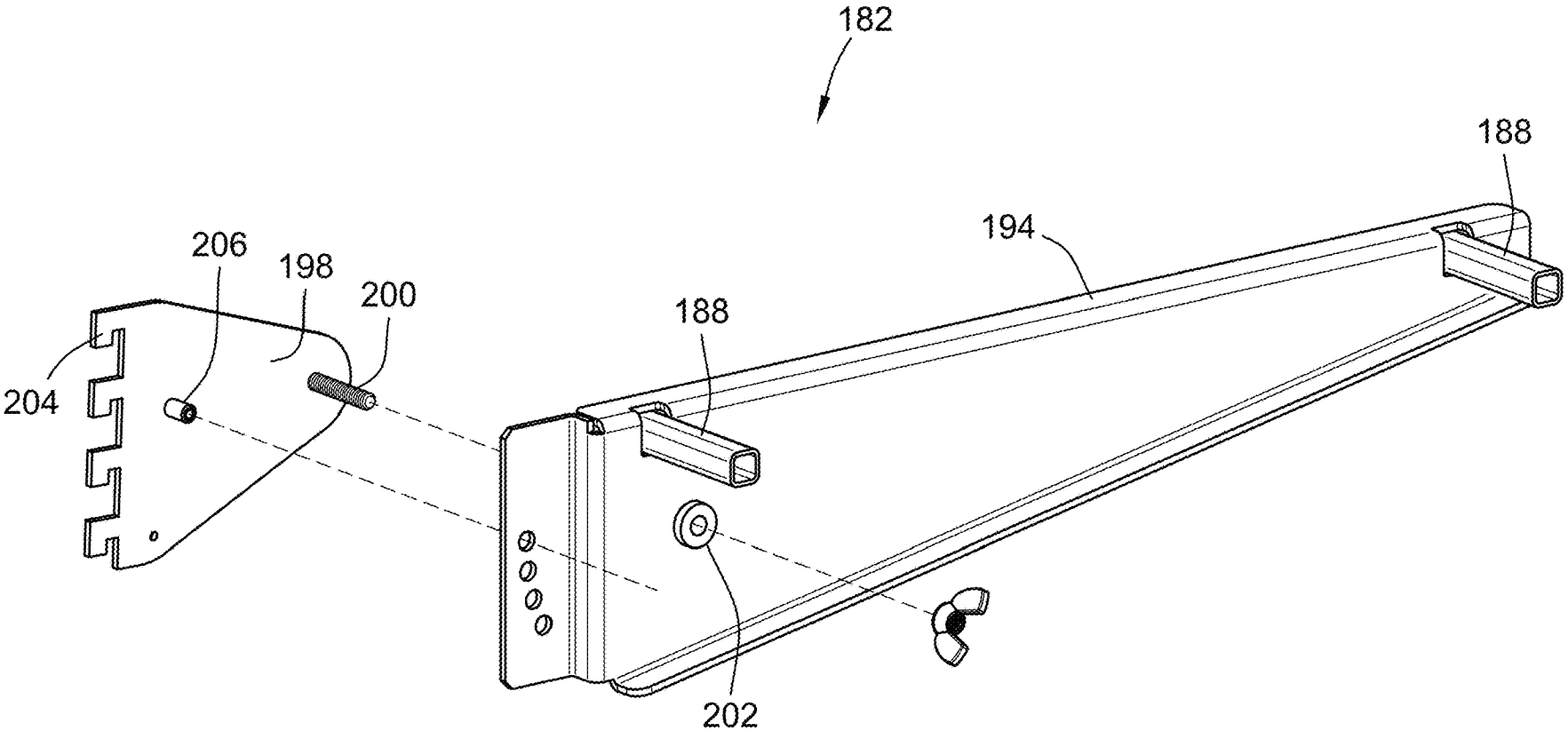
FIG. 15 is a perspective exploded view of a support arm of the shelf of FIG. 12.
Figure 16:
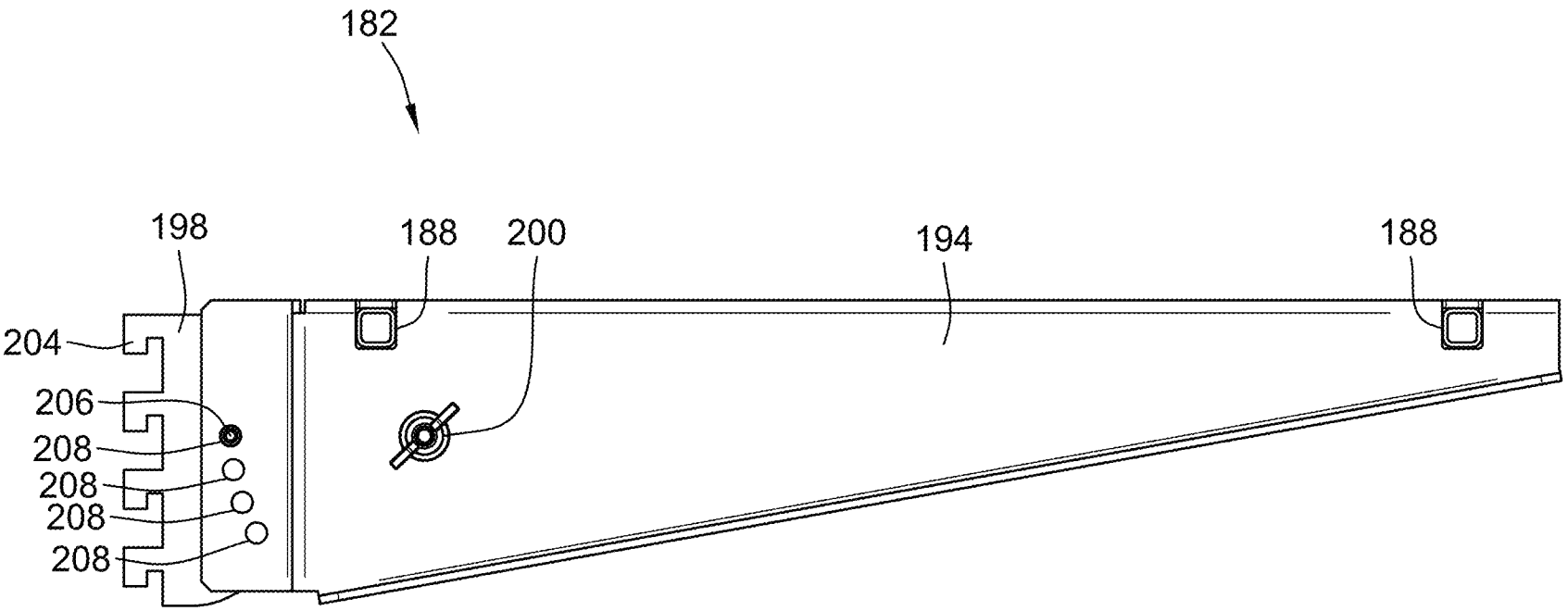
FIG. 16 is a side view of the support arm of FIG. 15.

With reference now to FIG. 15, the same illustrates an exploded view of a support arm 182. Each support arm 182 includes a main body 194 and an adjustable plate 198 mounted to main body 194. Each mounting post 188 is fixed to, and depends from, main body 194 as shown. Adjustable plate 198 attaches to main body 194 via a threaded fastener 200 as shown. Threaded fastener 200 extends through an aperture 202 of main body 194 and a wing nut or the like may then be used to tighten main body 194 and adjustable plate 198 together. Adjustable plate 198 also includes mounting features 204 which are received in the apertures 118 of upright supports 106*a-c* (see e.g. FIG. 2). These mounting features 204, however, can take any suitable form so as to facilitate the mounting of shelf 108 to any pre-existing structure.

Adjustable plate 198 also includes a pin 206 which is received in one of a plurality of apertures 208 (see FIG. 16) formed in main body 194. The angular presentation of each support arm 182 as it extends outwardly in a cantilevered manner from its associated upright support 106*a-c* is governed which of the apertures 208 pin 206 is received in. For example, as may be seen in FIG. 16, when pin 206 is received in the upper most aperture 208, main body 194 is essentially level, e.g. horizontal, compared to adjustable plate 198. However, by removing any hardware securing fastener 200, one may reposition adjustable plate 986 relative to main body 194 (or vice versa) and insert pin 206 into a different one of apertures 208.

Figure 17:
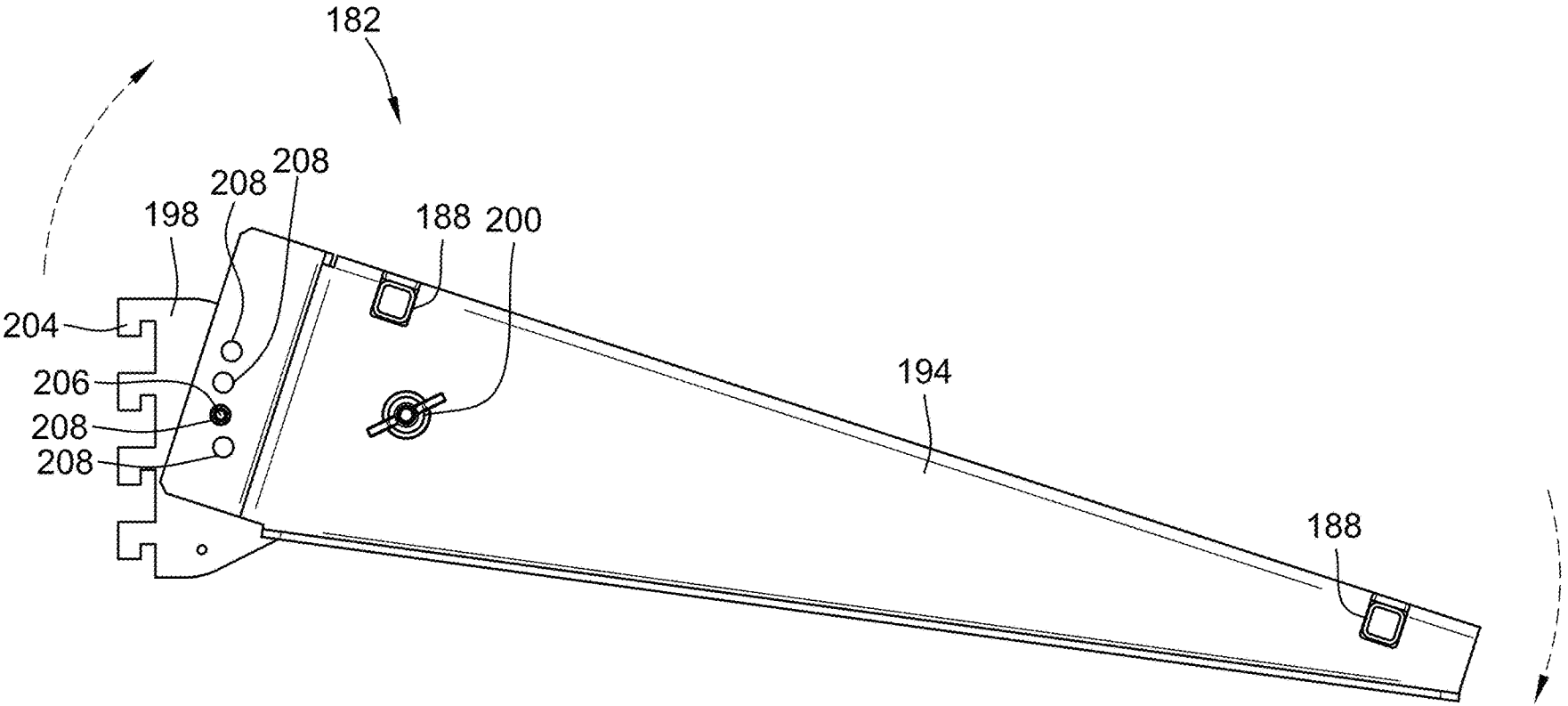
FIG. 17 is another side view of the support arm of FIG. 15, showing an alternate configuration thereof from that shown in FIG. 16.

For example, and turning now to FIG. 17, the same illustrates pin 206 in the third aperture down on main body 194. This causes main body, and hence support bars 184 and deck panels 180*a-d* mounted to supports bars 184 to, to tilt as shown. As a result, by this expedient manipulation, the user can readily govern the angle of shelf 108. Such a configuration is advantageous, for example, where the user desires to angle shelf 108 to provide a gravity feed function.

FIG. 18 illustrates another perspective view of deck panel 180*a*, and in particular shows a bottom surface 112 thereof. Deck panel 180*a* includes a honeycomb strengthening structure 214 depending from its bottom surface 212. A front and a rear channel 216 extend through this honeycomb structure 214 for receiving each support bar 184, respectively, therein. Each channel 216 includes finger tabs 218 which may snap around its associated support bar 184 to secure deck panel 180*a* to support bars 184. Although a front and rear channel 214, 216 are shown, the number of channels utilized may be varied to accommodate fewer or greater support bars 184.

Further, deck panel 180*a* also includes a d wire baffle support 230 for mounting a baffle plate thereto. Such a baffle plate may take on any form useful for directing air flow in a desired path. This wire baffle support 230 is slidable relative to deck panel 180*a* to allow for selective positioning of such a baffle plate.

The above introduced interlocking capability of deck panels 180*a-d* is achieved via interlocking features arranged adjacent opposed side edges of each deck panel 180*a-d*. In the example of deck panel 180*a* shown, these interlocking features include a plurality of tabs 220 adjacent one side edge which extend downwardly from bottom surface 212 as shown. These interlocking features also include a lip with a plurality of openings 222 arranged adjacent the other side edge as shown. Tabs 220 are received in openings 222 of an adjacent deck panel. Likewise, openings 222 receive tabs 220 of an adjacent deck panel. This interlocking feature ensures that adjacent deck panels cannot laterally move along support bars 184 relative to one another once interlocked. Although described as identical, it is also contemplated that end panels may be employed as the left-most and/or right-most panels in the row of interlocked deck panels. In the case of a right-most end panel, the same would omit the lip and openings 222 to provide a cleaner edge on the right most side of the shelf surface. In the case of the left-most end panel, the same would omit the tabs 220 for the same purpose.

FIG. 19 illustrates one tab 220 interlocked in one opening 222. Tabs 220 vertically enter openings 222. Once situated, tabs 220 are horizontally constrained within openings 222 due to their complimentary dove-tail shape. As a result, adjacent deck panels cannot laterally move along support bars 184 relative to one another once interlocked.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A shelf comprising:

a frame including:

a front support bar extending parallel to a horizontal axis;

a rear support bar extending parallel to the horizontal axis; and a first deck panel supported by the front and rear support bars, the deck panel having an upper support surface configured to support merchandise, the first deck panel having a front end and rear end, a first axis extends between the front and rear ends, the first deck panel being formed from plastic, the first deck panel having:

a plurality of first apertures formed in the upper support surface, the plurality of first apertures defining a first row, the first row extending parallel to the horizontal axis, each first aperture being elongated parallel to the horizontal axis;

a plurality of second apertures formed in the upper support surface, the plurality of second apertures defining a second row, the second row extending parallel to the horizontal axis, the second row being offset from the first row towards the rear end, each second aperture not being elongated parallel to the horizontal axis;

a plurality of third apertures formed in the upper surface, the plurality of third apertures defining a third row, the third row extending parallel to the horizontal axis, the third row being offset from the second row toward the rear end, each third aperture being elongated parallel to the horizontal axis, the plurality of third apertures including a first third aperture and a last third aperture, the first third aperture of the plurality of third apertures being the third aperture positioned closest to a first edge of the deck panel, the first third aperture being spaced a first distance from the first edge, the last third aperture of the plurality of third apertures being the third aperture positioned closest to a second edge of the deck panel, the last third aperture being spaced a second distance from the second edge;

a plurality of fourth apertures formed in the upper surface, the plurality of fourth apertures defining a fourth row, the fourth row extending parallel to the horizontal axis, the fourth row being offset from the third row toward the rear end, each fourth aperture being elongated parallel to the horizontal axis; and a plurality of fifth apertures formed in the upper support surface, the plurality of fifth apertures defining a fifth row, the fifth row extending parallel to the horizontal axis, the fifth row being offset from the fourth row towards the rear end, each fifth aperture not being elongated parallel to the horizontal axis;

a plurality of sixth apertures formed in the upper support surface including a first sixth aperture and a last sixth aperture, the plurality of sixth apertures defining a sixth row, the sixth row extending parallel to the horizontal axis, each sixth aperture being oblong, the first sixth aperture of the plurality of sixth apertures being the sixth aperture positioned closest to the first edge of the deck panel, the first sixth aperture being spaced a third distance from the first edge, the first distance being greater than the third distance, the last sixth aperture of the plurality of sixth apertures being the sixth aperture positioned closest to the second edge of the deck panel, the last sixth aperture being spaced a fourth distance from the second edge, the second distance being greater than the fourth distance.

2. The shelf of claim 1, wherein:

the first third aperture and last third aperture are the only third apertures; and the first sixth aperture and last third aperture are the only sixth apertures.

3. The shelf of claim 1, wherein the sixth row is positioned closer to the rear end than the third row.

4. A shelf comprising:

a frame including:

a front support bar extending parallel to a horizontal axis;

a rear support bar extending parallel to the horizontal axis; and a first deck panel supported by the front and rear support bars, the deck panel having an upper support surface configured to support merchandise, the first deck panel having a front end and rear end, a first axis extends between the front and rear ends, the first deck panel being formed from plastic, the first deck panel having:

a plurality of first apertures formed in the upper support surface, the plurality of first apertures defining a first row, the first row extending parallel to the horizontal axis, each first aperture being elongated parallel to the horizontal axis;

a plurality of second apertures formed in the upper support surface, the plurality of second apertures defining a second row, the second row extending parallel to the horizontal axis, the second row being offset from the first row towards the rear end, each second aperture not being elongated parallel to the horizontal axis;

a plurality of third apertures formed in the upper surface, the plurality of third apertures defining a third row, the third row extending parallel to the horizontal axis, the third row being offset from the second row toward the rear end, each third aperture being elongated parallel to the horizontal axis;

a plurality of fourth apertures formed in the upper surface, the plurality of fourth apertures defining a fourth row, the fourth row extending parallel to the horizontal axis, the fourth row being offset from the third row toward the rear end, each fourth aperture being elongated parallel to the horizontal axis; and a plurality of fifth apertures formed in the upper support surface, the plurality of fifth apertures defining a fifth row, the fifth row extending parallel to the horizontal axis, the fifth row being offset from the fourth row towards the rear end, each fifth aperture not being elongated parallel to the horizontal axis.

5. The shelf of claim 4, wherein each second aperture is circular.

6. The shelf of claim 4, further comprising a plurality of sixth apertures formed in the upper support surface, the plurality of sixth apertures defining a sixth row, the sixth row extending parallel to the horizontal axis, the sixth row being offset from the fifth row towards the rear end.

7. The shelf of claim 4, further comprising a plurality of sixth apertures formed in the upper support surface including a first sixth aperture and a last sixth aperture, the plurality of sixth apertures defining a sixth row, the sixth row extending parallel to the horizontal axis, each sixth aperture being oblong;

wherein:

the plurality of third apertures includes a first third aperture and a last third aperture;

the first third aperture of the plurality of third apertures being the third aperture positioned closest to a first edge of the deck panel, the first third aperture being spaced a first distance from the first edge;

the last third aperture of the plurality of third apertures being the third aperture positioned closest to a second edge of the deck panel, the last third aperture being spaced a second distance from the second edge;

the first and second edges extending generally parallel to the first axis;

the first sixth aperture of the plurality of sixth apertures being the sixth aperture positioned closest to the first edge of the deck panel, the first sixth aperture being spaced a third distance from the first edge, the first distance being greater than the third distance;

the last sixth aperture of the plurality of sixth apertures being the sixth aperture positioned closest to the second edge of the deck panel, the last sixth aperture being spaced a fourth distance from the second edge, the second distance being greater than the fourth distance.

8. The shelf of claim 7, wherein:

the first third aperture and last third aperture are the only third apertures; and the first sixth aperture and last third aperture are the only sixth apertures.

9. The shelf of claim 8, wherein the sixth row is positioned closer to the rear end than the third row.

* * * * *